US007791554B2

(12) United States Patent
Buxton et al.

(10) Patent No.: US 7,791,554 B2
(45) Date of Patent: Sep. 7, 2010

(54) TULIP ANTENNA WITH TUNING STUB

(75) Inventors: Carey Gwynne Buxton, Fredericksburg, VA (US); Brian David Sharp, Fredericksburg, VA (US)

(73) Assignee: The United States of America as represented by the Attorney General, Washington, DC (US)

( * ) Notice: Subject to any disclaimer, the term of this patent is extended or adjusted under 35 U.S.C. 154(b) by 187 days.

(21) Appl. No.: 12/220,584

(22) Filed: Jul. 25, 2008

(65) Prior Publication Data

US 2010/0019979 A1 Jan. 28, 2010

(51) Int. Cl.
*H01Q 21/26* (2006.01)
*H01Q 1/00* (2006.01)

(52) U.S. Cl. ..... 343/797; 343/722

(58) Field of Classification Search ..... 343/797, 343/722, 749

See application file for complete search history.

(56) References Cited

U.S. PATENT DOCUMENTS 6,351,246 B1 2/2002 McCorkle
6,559,810 B2 5/2003 McCorkle
6,587,540 B1 7/2003 Johnson et al.
6,590,545 B2 7/2003 McCorkle
6,842,141 B2 1/2005 Suh et al.
6,845,253 B1 1/2005 Schantz
6,914,573 B1 7/2005 McCorkle
7,023,396 B2 * 4/2006 Thudor et al. ..... 343/829
7,075,483 B2 7/2006 Okado
7,098,856 B2 8/2006 Okado
7,187,329 B2 3/2007 Okado
7,190,320 B2 3/2007 Okado
7,209,089 B2 4/2007 Schantz
7,317,420 B2 * 1/2008 Aisenbrey ..... 343/700 MS
7,352,334 B2 4/2008 Kuroda et al.
7,358,901 B2 4/2008 Eberhardt et al.
2005/0059348 A1 3/2005 Chae et al.
2005/0062670 A1 3/2005 Suh et al.
2005/0146471 A1 7/2005 Kwon et al.
2005/0151693 A1 7/2005 Schantz
2005/0168394 A1 8/2005 Kurashima et al.
2006/0055619 A1 3/2006 Sarabandi et al.

OTHER PUBLICATIONS

Dau-Chyrh Chang, et al., A Novel Tulip-Shaped Monopole Antenna for UWB Applications, Microwave & Optical Technology Letters, Feb. 2006, 307-312, vol. 48, No. 2.

* cited by examiner

*Primary Examiner*—Hoang V Nguyen

(57) ABSTRACT

The tulip antenna has two orthogonally intersecting conductive plates. Each intersecting plate has two ends, and one of these ends is smoothly tapered. The intersecting plates intersect such that the tapered end of both plates together form a tapered side when the intersecting plates intersect. An inner conductor of a coaxial cable is connected to the two intersecting plates at the tapered side of the intersecting plates. The inner conductor and the surrounding insulator pass through a tuning stub and then through a metallic ground plate. The tuning stub is connected to the ground plate. An aperture in the ground plate is sized such that the insulator can pass through it, just as the insulator can pass through the tuning stub. The tuning stub increases the upper frequency limit over which the antenna operates. The outer conductor of the coaxial cable is attached to the ground plate.

19 Claims, 4 Drawing Sheets

FIG. 5
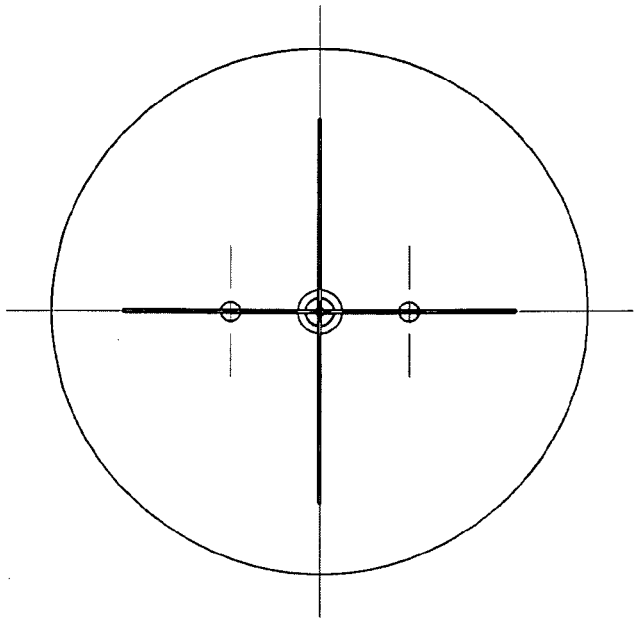
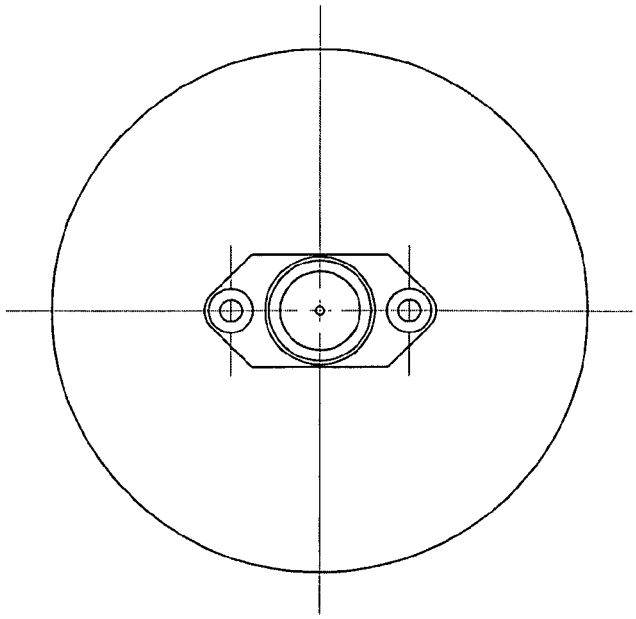
FIG. 6

TULIP ANTENNA WITH TUNING STUB

STATEMENT REGARDING FEDERALLY SPONSORED RESEARCH OR DEVELOPMENT

The invention described herein relates to the inventors' duties as government employees. The invention described herein may be manufactured and used by or for the government of the United States for all governmental purposes without the payment of any royalty.

BACKGROUND OF THE INVENTION

Electromagnetic energy can propagate through either a transmission line or through free space. Electromagnetic energy which propagates through a transmission line can be transmitted into free space by an antenna that is attached to the transmission line. Electromagnetic fields travel from a transmission line into an antenna through the feed point of the antenna. The power traveling down the transmission line induces a voltage across the feed point of the antenna. This voltage creates currents flowing on the antenna that, in turn, allow the electromagnetic energy to radiate into free space. Once in free space, the electromagnetic energy can propagate without the benefit of transmission lines. Antennas are designed to efficiently couple electromagnetic energy into free space with specified characteristics.

Any transmission line will have a specified characteristic impedance. The maximum amount of electromagnetic energy is transferred from the transmission line to the antenna when the input impedance of the antenna matches the input impedance of the transmission line. Usually, a transmission line has an impedance of 50 Ohms. Thus, to maximize electromagnetic energy transfer, an antenna connected to such a transmission line would have an input impedance of 50 Ohms. Likewise, a transmission line with a 300 Ohm impedance would require an antenna with a 300 Ohm impedance to maximize electromagnetic energy transfer.

The material from which the antenna is constructed will determine how much electromagnetic energy will radiate from the antenna. If the antenna is constructed from lossy (i.e. power absorbing) materials some of the power will be absorbed and the rest will radiate into free space. Measurements of the amount of radiation from an antenna made from a lossy material are used to create a gain pattern for the antenna. The gain pattern is a graph of the magnitude of the electromagnetic energy radiated from the antenna, typically measured in decibels, as a function of the angle around the antenna, typically measured in polar coordinates.

Most commonly, an antenna is assumed to be lossless, and the geometry of an antenna will determine the direction that electromagnetic energy will radiate from the antenna. In a lossless antenna, all of the electromagnetic energy that is input into the antenna is radiated into free space by the antenna. Thus, a lossless antenna neither creates nor destroys electromagnetic energy, but rather merely directs the electromagnetic energy. Thus, in the case of an antenna made from lossless materials, the gain pattern graphs the effect of the geometry of the antenna on the amount of electromagnetic energy radiated in any given point around the antenna. This gain pattern constructed for an antenna constructed from lossless materials is called the directivity pattern of the antenna.

The first antennas were dipole antennas and loop antennas. Dipole antennas are omni-directional and in their most basic form are constructed with two wires that are laid end-to-end. Each of the two wires is connected at one end to one of the conductors of a transmission line. When the transmission line is energized, a voltage appears across the feed point of the antenna. The voltage induces current on the two poles of the antenna referred to as a dipole.

As proven by image theory, one element of the dipole antenna can be replaced by a large metallic sheet to produce a monopole antenna having the same characteristics as one element of the dipole antenna. The well known concept of image theory is applied by antenna designers to create a monopole antenna from a dipole antenna. An antenna designer can create a monopole antenna having an electromagnetic field radiation pattern which is identical to the electromagnetic field radiation pattern of one pole of a dipole antenna by replacing one side of a dipole with large conductive plate that approximates a perfect electrical conductor plane. A perfect electrical conductor plane has no loss, and most metals are a good approximation to a perfect electrical conductor plane so long as the sheet of metal is large in comparison to the electromagnetic field radiation wavelength of the antenna. The currents are imaged through a perfect electrical conductor plane like a reflection in a mirror. The electromagnetic fields produced by currents generated by the monopole are equivalent to the electromagnetic fields produced by the original currents generated by the dipole antenna above the plane of the perfect electrical conductor plane.

Over the years, the shape of the dipoles used in a dipole antenna has evolved to increase the relatively narrow operational frequency band of the wire dipole antenna. Dipoles have been shaped like a bow-tie (two triangles), a bi-cone (two cones), and a fat dipole (wide pieces of copper tape). Broadband antennas are designed to work over a large frequency band. Typically these include helical antennas, biconical antennas, spiral antennas, log-periodic antennas, and tapered slot antennas. Tapered slot antennas have fat dipoles which smoothly taper down to a slot positioned between the two dipoles. The slot itself can take a variety of shapes including linear, exponential, or circular shapes. The smooth taper of the fat dipole toward the slot allows the antenna to operate over a large bandwidth.

BRIEF SUMMARY OF THE INVENTION

An object of the invention is to provide an antenna apparatus, comprising: a ground plane having a ground plane top surface, a ground plane bottom surface, and a ground plane aperture; a tuning stub located on the ground plane top surface and having a tuning stub aperture; a first conductor that is insulated from both the ground plane and the tuning stub and that passes through both the ground plane aperture and the tuning stub aperture; a first planar radiating element; a second planar radiating element, being constructed and arranged to intersect the first planar radiating element; wherein the first planar radiating element and second planar radiating element attach to the first conductor.

Another object of the invention is to provide an antenna apparatus wherein the first planar radiating element has a curved end, and wherein the second planar radiating element has a curved end.

Another object of the invention is to provide an antenna apparatus wherein the curved end of the first planar radiating element is elliptical and the curved end of the second planar radiating element is elliptical.

Another object of the invention is to provide an antenna apparatus wherein the curved end of the first planar radiating element is circular and the curved end of the second planar radiating element is circular.

Another object of the invention is to provide an antenna apparatus wherein the second planar radiating element is constructed and arranged to intersect the first radiating element orthogonally.

Another object of the invention is to provide an antenna apparatus wherein the first planar radiating element and the second planar radiating element attach to the conductor at the intersection of the first planar radiating element and the second planar radiating element.

Another object of the invention is to provide an antenna apparatus wherein the conductor is orthogonal to both the ground plane and the tuning stub.

Another object of the invention is to provide an antenna apparatus further comprising a second conductor, wherein the second conductor is insulated from the first conductor and connected to the bottom surface of the ground plane.

Another object of the invention is to provide an antenna comprising: a ground plate having a ground plate aperture; a coaxial connector that is connected to the ground plate so that an inner conductor of the coaxial connector and a surrounding insulator passes through the ground plate aperture; a tuning stub on the ground plate having a tuning stub thickness, a tuning stub diameter, and a tuning stub aperture such that the inner conductor of the coaxial connector and surrounding insulator passes through the tuning stub aperture, wherein the tuning stub thickness and the tuning stub diameter will affect the high frequency response of the antenna; a first conductive sheet having a first tapered end, a first blunt end, a first slot, and a first cutout for receiving the inner conductor of the coaxial connector, wherein the first cutout is located in the center of the first tapered end; a second conductive sheet having a second tapered end, a second blunt end, a second slot, and a second cutout for receiving the inner conductor of the coaxial connector, wherein the second cutout is located in the center of the second tapered end.

Another object of the invention is to provide an antenna wherein the ground plate is circular and the ground plate aperture is located in the center of the ground plate.

Another object of the invention is to provide an antenna wherein the inner conductor of the coaxial connector extends perpendicularly from the ground plate.

Another object of the invention is to provide an antenna wherein the first tapered end is elliptically tapered and the second tapered end is elliptically tapered.

Another object of the invention is to provide an antenna wherein the first tapered end is circularly tapered and the second tapered end is circularly tapered.

Another object of the invention is to provide an antenna wherein the first slot and the second slot are constructed and arranged so that the first conductive sheet and the second conductive sheet will intersect such that the first conductive sheet and the second conductive sheet are perpendicular to each other.

Another object of the invention is to provide an antenna wherein the first cutout and the second cutout are constructed and arranged such that when the first conductive sheet and the second conductive sheet intersect, the inner conductor can fit inside the first cutout and the second cutout and the inner conductor is situated in the center of the line formed by the intersection of the first conductive sheet and the second conductive sheet.

Another object of the invention is to provide a method for tuning an antenna comprising: placing a circular tuning stub, having a thickness, and a diameter, in electrical contact with a ground plane of an antenna having two orthogonally intersecting radiating elements elevated above the ground plane and orthogonal to the ground plane; adjusting the thickness of the tuning stub to improve the high frequency response of the antenna; and adjusting the diameter of the tuning stub to improve the high frequency response of the antenna.

BRIEF DESCRIPTION OF THE SEVERAL VIEWS OF THE DRAWING

FIG. 5 is a top view of an embodiment of the tulip antenna.

FIG. 6 is a bottom view of an embodiment of the tulip antenna.

DETAILED DESCRIPTION OF THE INVENTION

Figure 1:
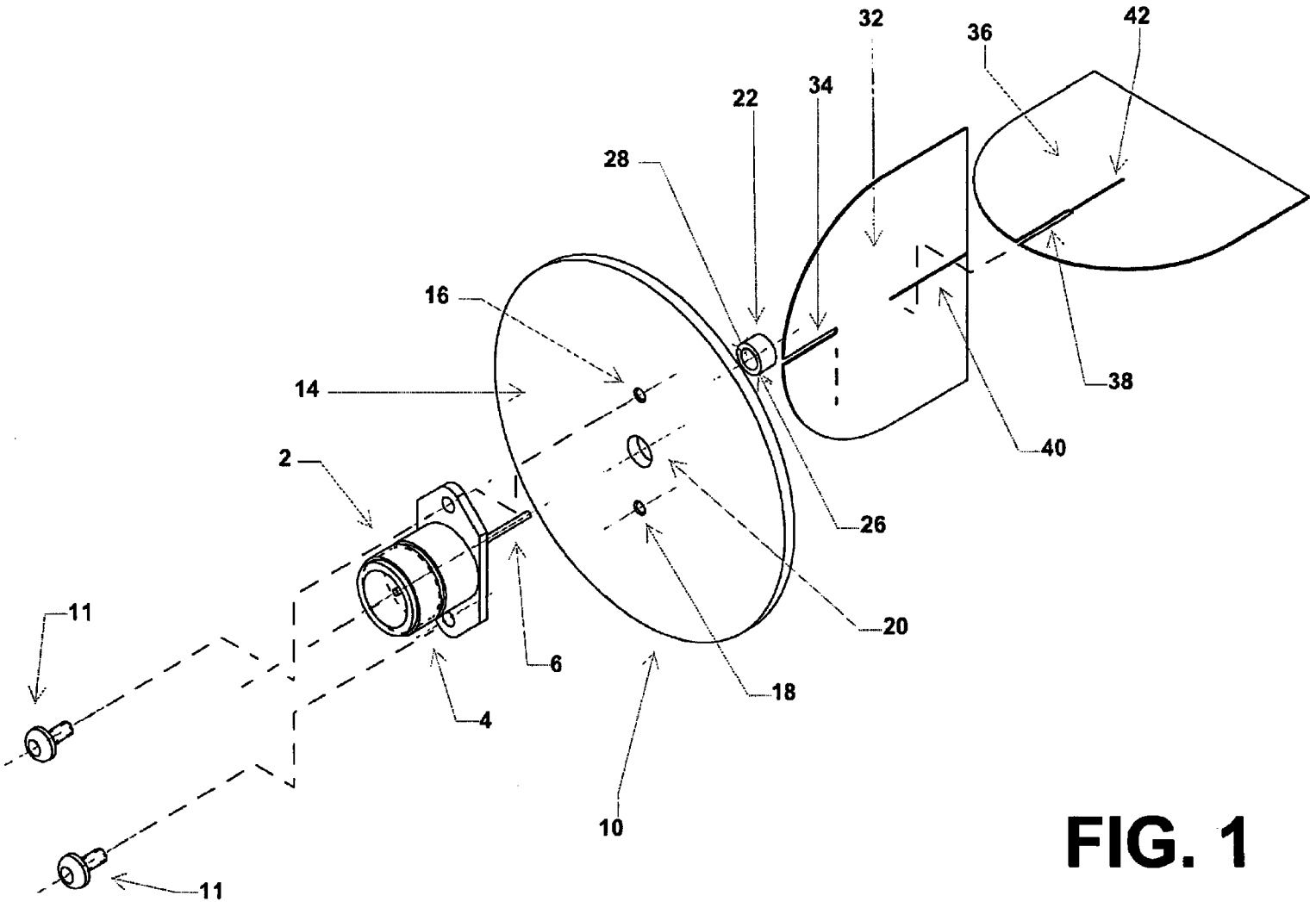
FIG. 1 is an exploded view of an embodiment of the tulip antenna.
Figure 2:
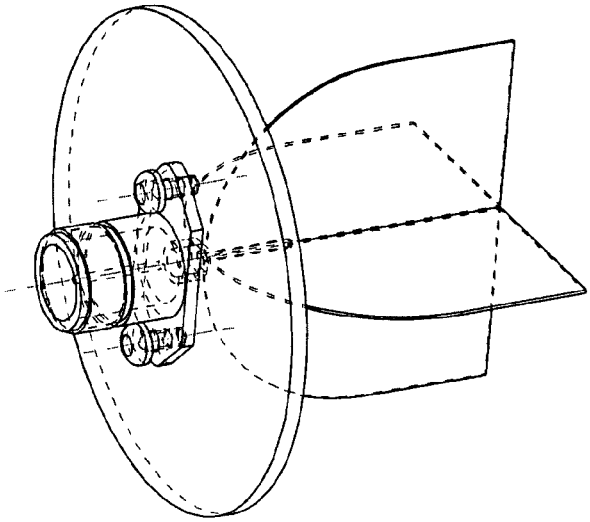
FIG. 2 is a side perspective view of an embodiment of the tulip antenna.

The tulip antenna operates over an extremely broad range of frequencies and is easy to construct. The tulip antenna has two orthogonally intersecting conductive plates. The two intersecting plates are required to create a tulip antenna with an omni-directional electromagnetic field pattern. Each intersecting plate has two ends, and one of these ends is smoothly tapered. The smooth taper allows for the antenna to operate over a broad range of frequencies. The intersecting plates intersect such that the tapered end of both plates together form a tapered side when the intersecting plates intersect. An inner conductor of a coaxial cable is connected to the two intersecting plates at the tapered side of the intersecting plates. The inner conductor connects to both of the intersecting plates on the center of the line formed by the intersection of the intersecting plates and connects to the two plates on this line in the centers of both of the intersecting plates. The portion of the inner conductor not connected to the intersecting plates is surrounded by an insulator. The inner conductor and the surrounding insulator pass through a tuning stub and then through a metallic ground plate. The ground plate is orthogonal to both of the intersecting orthogonal plates. The tuning stub is a circular flat ring that is sized such that the insulator can pass through the tuning stub. The tuning stub is connected to the ground plate. An aperture in the ground plate is sized such that the insulator can pass through it, just as the insulator can pass through the tuning stub. The tuning stub increases the upper frequency limit over which the antenna operates. The outer conductor of the coaxial cable is attached to the ground plate.

The height of the two intersecting plates limits the lower bound of the operational frequency bandwidth of the antenna. At the lower bound of the operational frequency bandwidth of the antenna, the two intersecting plates act as an omni-directional fat dipole antenna because each of the two intersecting plates allow for low frequency signals to travel one quarter of a wavelength, which is necessary for radiation to occur. In the middle of the operational frequency bandwidth of the antenna, the tapered side of the intersecting plates together with the ground plate act as an omni-directional tapered slot antenna because the tapered slot creates a smooth transition from the coaxial feed line to the two intersecting plates over a broad range of mid-band frequencies. At the upper bound of the operational frequency bandwidth of the antenna, the tapered side of the intersecting plates together with the ground plate also acts as an omni-directional slot antenna, and the spacing of the crossed pieces over the ground plane determines the highest frequency at which the antenna operates.

Small changes in the antenna structure near the feed point of the tapered antenna have very little affect on the characteristics of an antenna at low frequencies, but these changes have a great affect on the characteristics of an antenna at high frequencies. Thus, when a tuning stub is added to the surface of the ground plate, the upper bound of the operational frequency bandwidth at which the antenna operates increases without affecting the operation of the antenna at lower frequencies. The tuning stub is an extension of the surface of the ground plate facing the two intersecting plates. The tuning stub reduces the width of the slot for high frequency signals by decreasing the distance between the two intersecting plates and the ground plate near the intersection of the two intersecting plates. In practice, the tuning stub has the effect of extending the frequency at which the antenna has a 50 Ohm input impedance without disrupting the 50 Ohm match established for the antenna when it is operating at lower frequencies.

The upper frequency at which the antenna has a 50 Ohm input impedance is inversely proportional to the diameter of the tuning stub aperture located in the center of the tuning stub. The diameter of this tuning stub aperture is dictated by the diameter of the inner conductor and surrounding dielectric insulation of the coaxial feed line used with the antenna. In turn, the diameter of the inner conductor and surrounding dielectric insulation of the coaxial feed line varies depending on the type of connector used with the antenna. The diameter of the inner conductor and surrounding dielectric insulation of the coaxial feed line of a type N connector is 0.166 inches. In a preferred embodiment of the invention, the diameter of the tuning stub aperture is 0.166 inches, the outer diameter of the tuning stub is 0.191 inches, and the stub height is 0.056 inches. In the preferred embodiment, the dielectric insulation extends a height of 0.043" above the height of the tuning stub. Using a connector with a smaller diameter of the inner conductor and surrounding insulation of the coaxial feed line would allow for a smaller inner diameter of the stub, which would allow for tuning at higher frequencies.

Figure 3:
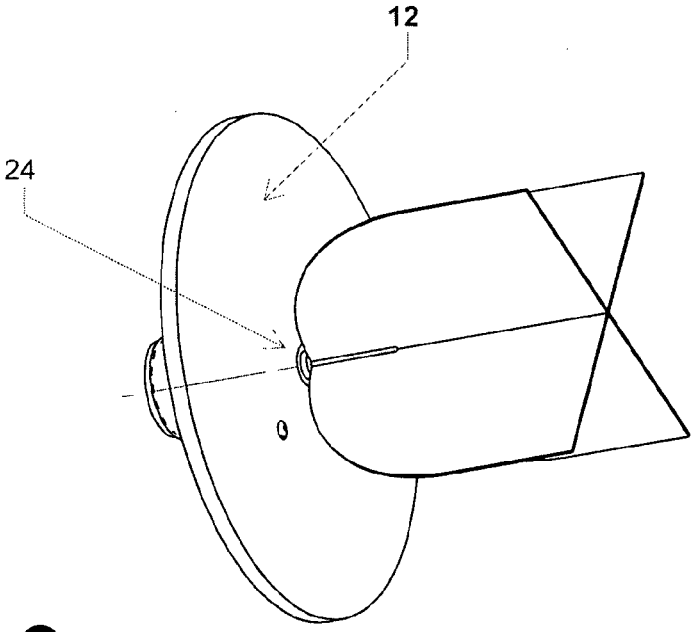
FIG. 3 is a side perspective view of an embodiment of the tulip antenna.
Figure 4:
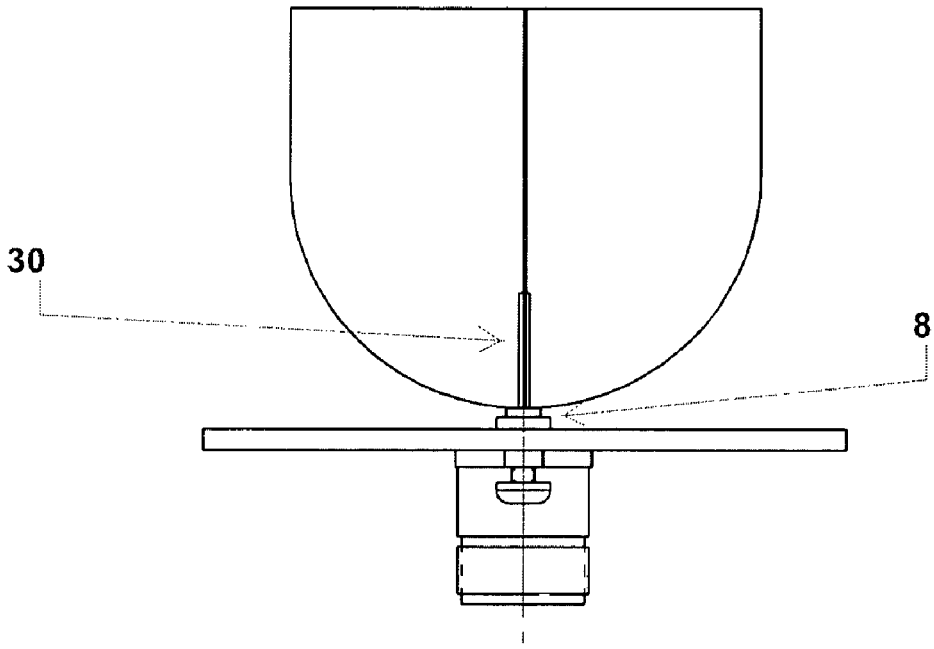
FIG. 4 is a side view of an embodiment of the tulip antenna.

FIG. 1 is an exploded view of an embodiment of the tulip antenna. Coaxial connector 2 includes an outer conductor 4 and an inner conductor 6. Outer conductor 4 and inner conductor 6 are separated by an insulator 8 (shown in FIG. 4). Ground plate 10 is made of metal and has a top surface 12 (shown in FIG. 3) and a bottom surface 14. The ground plate includes apertures 16 and 18 to allow for coaxial connector 2 to be attached to the bottom surface 14 of the ground plate 10 by screws 11. Ground plate 10 is thus electrically connected to the outer conductor 4 of the coaxial connector 2. Ground plate 10 also includes aperture 20 to allow for the inner conductor 6 and insulator 8 to pass through the ground plate 10. A tuning stub 22 has a top surface 24 (shown in FIG. 3) and a bottom surface 26 and an aperture 28. The aperture 28 of the tuning stub 22 is the same size as the aperture 20 such that the inner conductor 6 and the insulator 8 of the coaxial connector 2 can pass through both aperture 20 and aperture 28. The bottom surface 26 of the tuning stub 22 is formed so that it sits flush with the top surface 12 of the ground plate 10 and the tuning stub 22 and the ground plate 10 are electrically and mechanically connected to each other.

The inner conductor 6, surrounded by the insulator 8 (shown in FIG. 4), extends perpendicularly from the top surface 12 of the ground plate 10 beyond the tuning stub 22. The inner conductor extends beyond the insulator 8 such that a portion 30 (shown in FIG. 4) of the inner conductor 6 that extends perpendicularly from the top surface of the ground plate 10 is not surrounded by insulation 8.

The portion 30 of the inner conductor 6 connects to a plate 32 at cutout 34 and a plate 36 at cutout 38. It is important that the portion 30 of the inner conductor 6 connects to plate 32 and plate 36 in the center of the thickness of each of plate 32 and 36. Plate 32 has a slot 40 and plate 36 has a slot 42. Slot 40 and slot 42 are constructed and arranged so that plate 32 and plate 36 connect such that ground plate 10, plate 32, and plate 36 are all perpendicular to each other.

While preferred embodiments of the present invention have been described above, it is to be understood that any and all equivalent realizations of the present inventions are included within the scope and spirit thereof. Thus, the embodiments depicted are presented by way of example only and are not intended as limitations upon the present invention. While particular embodiments of the invention have been described and shown, it will be understood by those of ordinary skill in the art that the present invention is not limited thereto because many modifications can be made to it. Therefore, it is contemplated that any and all such embodiments are included in the present invention as may fall within the literal or equivalent scope of the appended claims.

What is claimed is:

1. An antenna apparatus, comprising:

a ground plane having a ground plane top surface, a ground plane bottom surface, and a ground plane aperture;

a tuning stub located on the ground plane top surface and having a tuning stub aperture;

a first conductor that is insulated from both the ground plane and the tuning stub and that passes through both the ground plane aperture and the tuning stub aperture;

a first planar radiating element; and a second planar radiating element, being constructed and arranged to intersect the first planar radiating element;

wherein the first planar radiating element and second planar radiating element attach to the first conductor.

2. The apparatus of claim 1, wherein the first planar radiating element has a curved end, and wherein the second planar radiating element has a curved end.

3. The apparatus of claim 2, wherein the curved end of the first planar radiating element is elliptical and the curved end of the second planar radiating element is elliptical.

4. The apparatus of claim 2, wherein the curved end of the first planar radiating element is circular and the curved end of the second planar radiating element is circular.

5. The apparatus of claim 1, wherein the second planar radiating element is constructed and arranged to intersect the first radiating element orthogonally.

6. The apparatus of claim 1, wherein the first planar radiating element and the second planar radiating element attach to the first conductor at the intersection of the first planar radiating element and the second planar radiating element.

7. The apparatus of claim 1, wherein the conductor is orthogonal to both the ground plane and the tuning stub.

8. The apparatus of claim 1, further comprising a second conductor, wherein the second conductor is insulated from the first conductor and connected to the ground plane.

9. An antenna comprising:

a ground plate having a ground plate aperture;

a coaxial connector that is connected to the ground plate so that an inner conductor of the coaxial connector and a surrounding insulator pass through the ground plate aperture;

a tuning stub on the ground plate having a tuning stub thickness, a tuning stub diameter, and a tuning stub aperture such that the inner conductor of the coaxial connector and surrounding insulator pass through the tuning stub aperture, wherein the tuning stub thickness and the tuning stub diameter will affect the high frequency response of the antenna;

a first conductive sheet having a first tapered end, a first blunt end, a first slot, and a first cutout for receiving the inner conductor of the coaxial connector, wherein the first cutout is located in the center of the first tapered end; and a second conductive sheet having a second tapered end, a second blunt end, a second slot, and a second cutout for receiving the inner conductor of the coaxial connector, wherein the second cutout is located in the center of the second tapered end.

10. The antenna of claim 9, wherein the ground plate is circular and the ground plate aperture is located in the center of the ground plate.

11. The antenna of claim 9, wherein the inner conductor of the coaxial connector extends perpendicularly from the ground plate.

12. The antenna of claim 9, wherein the first tapered end is elliptically tapered and the second tapered end is elliptically tapered.

13. The antenna of claim 9, wherein the first tapered end is circularly tapered and the second tapered end is circularly tapered.

14. The antenna of claim 9, wherein the first slot and the second slot are constructed and arranged so that the first conductive sheet and the second conductive sheet will intersect such that the first conductive sheet and the second conductive sheet are perpendicular to each other.

15. The antenna of claim 9, wherein the first cutout and the second cutout are constructed and arranged such that when the first conductive sheet and the second conductive sheet intersect, the inner conductor can fit inside the first cutout and the second cutout and the inner conductor is situated in the center of the line formed by the intersection of the first conductive sheet and the second conductive sheet.

16. A method for tuning an antenna comprising:

placing a circular tuning stub, having a thickness, and a diameter, in electrical contact with a ground plane of an antenna having two orthogonally intersecting radiating elements elevated above the ground plane and orthogonal to the ground plane;

adjusting the thickness of the tuning stub to improve the high frequency response of the antenna; and adjusting the diameter of the tuning stub to improve the high frequency response of the antenna.

17. The method of claim 16, wherein the thickness of the tuning stub is adjusted to 0.056 inches.

18. The method of claim 17, further comprising adjusting the height of an insulator passing through the tuning stub such that the insulator extends a height of 0.043" above the thickness of the tuning stub.

19. The method of claim 16, wherein the diameter of the tuning stub is 0.191 inches.

* * * * *